US011408329B2

(12) United States Patent
Schock et al.

(10) Patent No.: US 11,408,329 B2
(45) Date of Patent: Aug. 9, 2022

(54) ENGINE TURBULENT JET IGNITION SYSTEM

(71) Applicant: Board of Trustees of Michigan State University, East Lansing, MI (US)

(72) Inventors: Harold J. Schock, Brighton, MI (US); Thomas R. Stuecken, Eagle, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 0 days.

(21) Appl. No.: 17/115,943

(22) Filed: Dec. 9, 2020

(65) Prior Publication Data

US 2021/0189946 A1 Jun. 24, 2021

Related U.S. Application Data

(60) Provisional application No. 62/950,511, filed on Dec. 19, 2019.

(51) Int. Cl.

| | |
|---|---|
| ***F02B 19/10*** | (2006.01) |
| ***F02B 19/12*** | (2006.01) |
| ***F02F 1/24*** | (2006.01) |
| ***F02M 31/04*** | (2006.01) |
| *F02B 19/00* | (2006.01) |

(52) U.S. Cl.

CPC ..... *F02B 19/1028* (2013.01); *F02B 19/10* (2013.01); *F02B 19/108* (2013.01); *F02B 19/1014* (2013.01); *F02B 19/1023* (2013.01); *F02B 19/12* (2013.01); *F02F 1/242* (2013.01); *F02M 31/042* (2013.01); *F02B 19/1004* (2013.01); *F02B 19/1019* (2013.01); *F02B 2019/002* (2013.01)

(58) Field of Classification Search

None

See application file for complete search history.

(56) References Cited

U.S. PATENT DOCUMENTS 1,700,603 A * 1/1929 Vreeland ..... F02B 19/1033 138/40
2,050,392 A 8/1936 Starr
(Continued)

FOREIGN PATENT DOCUMENTS

AU 2018207981 A1 * 7/2019 ..... F02B 19/02
CA 3048883 A1 * 7/2018 ..... F02B 19/02
(Continued)

OTHER PUBLICATIONS

Gussak, L.A., et al.; "The Application of Lag-Process in Prechamber Engines," SAE Paper 790692, Society of Automotive Engineers, 1980, pp. 2355-2380.

(Continued)

*Primary Examiner* — Kevin R Steckbauer

(74) *Attorney, Agent, or Firm* — Harness, Dickey & Pierce PLC

(57) ABSTRACT

An engine system employs a pre-assembled and/or removable cartridge. In another aspect, an ignitor, a fuel injector and an air inlet valve are all accessible from a top of a cartridge even after assembly of the cartridge to an engine cylinder head. A further aspect positions centerlines of an ignitor, a fuel injector and an air inlet valve angularly offset from each other and also angularly offset from a vertical centerline of a cartridge to which they are mounted.

25 Claims, 11 Drawing Sheets

(56) References Cited

U.S. PATENT DOCUMENTS 3,230,939 A * 1/1966 Goossak ..... F02B 19/1004 123/258
3,270,722 A * 9/1966 Springer ..... F02B 25/00 123/285
3,402,704 A * 9/1968 Witzky ..... F02B 43/00 123/145 A
3,406,667 A * 10/1968 Evans ..... F02B 19/1004 123/286
3,508,530 A * 4/1970 Clawson ..... F02B 53/00 123/275
3,738,333 A * 6/1973 Vogelsang ..... F02B 19/1004 123/260
3,799,140 A * 3/1974 Vogelsang ..... F02B 19/16 123/270
3,805,747 A * 4/1974 Nakagawa ..... F02B 53/04 123/274
3,830,205 A * 8/1974 Date ..... F02B 19/1038 123/259
3,924,592 A * 12/1975 Miyaki ..... F02B 19/1028 123/286
3,957,021 A * 5/1976 Loyd, Jr. ..... F02B 53/10 123/259
3,963,003 A * 6/1976 Downs ..... F02B 23/08 123/259
4,060,058 A 11/1977 Hideg et al.
4,075,996 A * 2/1978 Hisserich ..... F02B 7/02 123/258
4,161,927 A * 7/1979 Yagi ..... F02B 19/1028 123/261
4,182,284 A * 1/1980 Yagi ..... F02B 19/1028 123/260
4,232,638 A * 11/1980 Takahashi ..... F02M 45/086 123/285
4,259,932 A 4/1981 Hideg et al.
4,300,497 A * 11/1981 Webber ..... F02B 19/165 123/270
4,332,224 A 6/1982 Latsch et al.
4,372,264 A * 2/1983 Trucco ..... F02B 19/02 123/557
4,429,669 A 2/1984 Burley
4,592,318 A 6/1986 Pouring
4,903,656 A * 2/1990 Nakazono ..... F02D 41/345 123/259
5,036,669 A 8/1991 Earleson et al.
5,069,178 A * 12/1991 Kawamura ..... F02B 19/02 123/276
5,081,969 A 1/1992 Long, III
5,203,298 A * 4/1993 Manolis ..... F02B 19/108 123/266
5,222,993 A * 6/1993 Crane ..... F02M 21/029 123/266
5,454,356 A 10/1995 Kawamura
5,520,864 A 5/1996 Frei
5,555,868 A * 9/1996 Neumann ..... F02B 19/108 123/275
5,560,326 A * 10/1996 Merritt ..... F02B 19/02 123/259
6,098,013 A * 8/2000 Mueller ..... F02D 41/1498 73/114.02
6,513,483 B2 * 2/2003 Riggs ..... F02B 19/1009 123/267
6,539,913 B1 * 4/2003 Gardiner ..... F02B 53/04 123/236
6,606,973 B2 * 8/2003 Moe ..... F02B 55/02 123/238
6,694,944 B2 2/2004 Agama et al.
6,739,289 B2 * 5/2004 Hiltner ..... F02B 43/10 123/3
6,843,220 B2 * 1/2005 Lausch ..... F02B 19/108 123/255
6,854,439 B2 2/2005 Regueiro
6,953,020 B2 10/2005 Kojic et al.
7,000,596 B2 2/2006 Zurloye et al.
7,100,567 B1 * 9/2006 Bailey ..... F02B 19/06 123/280
7,107,964 B2 9/2006 Kojic et al.
7,370,626 B2 * 5/2008 Schubert ..... F02B 19/12 123/275
7,398,743 B2 7/2008 Fiveland
7,584,739 B2 9/2009 Takahashi et al.
7,950,364 B2 * 5/2011 Nerheim ..... F02B 19/1014 123/259
8,567,369 B2 * 10/2013 Johnson ..... F02B 25/14 123/285
8,757,127 B2 * 6/2014 Ishida ..... F01P 3/16 123/275
8,813,695 B2 * 8/2014 Meldolesi ..... F02B 19/02 123/53.1
8,826,883 B2 * 9/2014 Ishida ..... F02B 19/108 123/275
8,857,405 B2 * 10/2014 Attard ..... F02B 19/14 123/266
8,910,612 B2 * 12/2014 Woo ..... F02B 19/10 123/289
8,925,518 B1 * 1/2015 Riley ..... F02D 41/0027 123/304
9,038,594 B2 * 5/2015 Thomassin ..... F02B 19/10 123/209
9,091,222 B2 7/2015 Furukawa
9,194,402 B2 * 11/2015 Rohs ..... F02B 75/26
9,353,674 B2 * 5/2016 Bunce ..... F02B 19/1057
9,376,955 B2 6/2016 Reitz et al.
9,528,434 B1 * 12/2016 Thomassin ..... F02B 53/12
9,593,633 B1 * 3/2017 Kim ..... F02D 41/1497
9,653,886 B2 5/2017 Chiera et al.
9,670,827 B2 * 6/2017 Taliaferro ..... F02B 19/1095
9,840,963 B2 12/2017 Chiera et al.
9,856,848 B2 1/2018 Chiera et al.
9,890,689 B2 * 2/2018 Hampson ..... F02D 41/3005
9,890,690 B2 * 2/2018 Chiera ..... F02M 21/0275
9,893,497 B2 2/2018 Chiera et al.
9,920,714 B2 * 3/2018 Ginter ..... F02M 25/03
10,006,358 B2 * 6/2018 Thomassin ..... F02B 55/08
10,018,104 B2 * 7/2018 Grover, Jr. ..... H05H 1/2406
10,041,402 B2 * 8/2018 Schulz ..... F01C 1/22
10,054,102 B2 8/2018 Chiera et al.
10,072,559 B2 * 9/2018 Schulz ..... F02B 53/02
10,125,676 B2 * 11/2018 Thomassin ..... F01C 1/22
10,161,296 B2 * 12/2018 Schock ..... F02B 19/1023
10,208,651 B2 2/2019 Tozzi et al.
10,280,830 B2 * 5/2019 Thomassin ..... F02B 19/1085
10,287,969 B2 * 5/2019 Boyde ..... F02B 19/1085
10,337,397 B2 * 7/2019 Shelby ..... F02B 19/16
10,400,696 B2 * 9/2019 Blaxill ..... F02B 19/1085
10,436,108 B2 * 10/2019 Shmueli ..... F02B 47/02
10,458,312 B2 * 10/2019 Wang ..... F02B 19/12
10,533,486 B2 * 1/2020 Schulz ..... F02B 19/12
10,544,732 B2 * 1/2020 Villeneuve ..... F01C 21/18
10,557,407 B2 * 2/2020 Dussault ..... F01C 1/22
10,578,012 B2 * 3/2020 Thomassin ..... F01C 21/183
10,697,365 B2 * 6/2020 Thomassin ..... F01C 21/06
10,865,699 B2 * 12/2020 Thomassin ..... F02D 35/025
11,060,443 B1 * 7/2021 Thomas ..... F02M 61/14
11,085,402 B1 * 8/2021 Vroman ..... F02M 23/04
2003/0056749 A1 * 3/2003 Beckertgis ..... F02B 75/02 123/258
2005/0092181 A1 5/2005 Shih et al.
2008/0017165 A1 * 1/2008 Schubert ..... F02D 41/3094 123/261
2008/0047511 A1 2/2008 Taye et al.
2009/0132153 A1 5/2009 Shutty et al.
2011/0308495 A1 12/2011 Furukawa
2011/0315102 A1 12/2011 David et al.
2012/0103302 A1 * 5/2012 Attard ..... F02B 19/1057 123/260
2012/0118262 A1 * 5/2012 Johnson ..... F02B 25/14 123/260
2012/0160217 A1 6/2012 Ashizawa
2013/0220269 A1 * 8/2013 Woo ..... F02P 15/006 123/260

(56) References Cited

U.S. PATENT DOCUMENTS

| | | | | |
|---|---|---|---|---|
| 2014/0144406 | A1* | 5/2014 | Schock | F02B 19/12 123/260 |
| 2014/0158083 | A1* | 6/2014 | Lee | F02B 19/06 123/289 |
| 2014/0261298 | A1 | 9/2014 | Sasidharan et al. | |
| 2014/0331960 | A1* | 11/2014 | Lee | F02B 19/06 123/275 |
| 2015/0059456 | A1 | 3/2015 | Niessner et al. | |
| 2015/0233280 | A1 | 8/2015 | Ernst et al. | |
| 2016/0061094 | A1* | 3/2016 | Taliaferro | F02B 19/12 123/254 |
| 2016/0230645 | A1* | 8/2016 | Schock | F02B 19/1052 |
| 2016/0252010 | A1* | 9/2016 | Villeneuve | F02B 19/12 123/209 |
| 2017/0096932 | A1* | 4/2017 | Chiera | F02M 21/0275 |
| 2017/0191406 | A1 | 7/2017 | Rabhi | |
| 2018/0080371 | A1* | 3/2018 | Dussault | F01C 21/18 |
| 2018/0135506 | A1* | 5/2018 | Grover, Jr. | F02P 5/045 |
| 2020/0182217 | A1* | 6/2020 | Keum | H05H 1/2406 |
| 2021/0156325 | A1* | 5/2021 | Glugla | F02D 9/02 |
| 2021/0189946 | A1* | 6/2021 | Schock | F02F 1/242 |
| 2021/0277820 | A1* | 9/2021 | Basmaji | F02M 23/04 |

FOREIGN PATENT DOCUMENTS

| | | | | | |
|---|---|---|---|---|---|
| CN | 102333944 | A | | 1/2012 | |
| CN | 106014694 | A | | 10/2016 | |
| CN | 110291278 | A | * | 9/2019 | F02B 19/02 |
| DE | 102005039713 | A1 | | 2/2007 | |
| DE | 10 2017 009 613 | A1 | | 4/2018 | |
| EP | 3568579 | A1 | * | 11/2019 | F02B 19/02 |
| FR | 3061743 | A1 | * | 7/2018 | F02B 19/02 |
| FR | 3061743 | B1 | * | 8/2019 | F02B 19/02 |
| JP | 2002 266 643 | A | | 9/2002 | |
| JP | 2002266644 | A | * | 9/2002 | F02B 19/12 |
| JP | 2005-273 494 | A | | 10/2005 | |
| KR | 20190104551 | A | * | 9/2019 | F02B 19/02 |
| WO | WO 2010/094 552 | A1 | | 8/2010 | |
| WO | WO-2015138987 | A1 | | 9/2015 | |
| WO | WO-2017184610 | A1 | * | 10/2017 | F02B 19/06 |
| WO | WO-2018130772 | A1 | * | 7/2018 | F02B 19/02 |
| WO | WO-2019/027800 | A2 | | 2/2019 | |

OTHER PUBLICATIONS

Dainton, L.; "Nikolai Nikolaevich Semenov. Apr. 16, 1896-Sep. 25, 1986," Biographical Memoirs of Fellows of the Royal Society, vol. 36, Dec. 1, 1990, pp. 527-543.

Oppenheim, A. K.; "Prospects for Combustion in Piston Engines," SAE 2002-01-0999, Society of Automotive Engineers, Mar. 4-7, 2002, 17 pages.

Toulson, E.; Thesis: "Applying Alternative Fuels in Place of Hydrogen to the Jet Ignition Process," The Department of Mechanical Engineering, the University of Melbourne, 2008, 402 pages.

Toulson, E., et al.; "Gas Assisted Jet Ignition of Ultra-Lean LPG in a Spark Engine," SAE 2009-01-0506, SAE International, 2009, 21 pages.

Toulson,E., et al.; "Modeling Alternative Prechamber Fuels in Jet Assisted Ignition of Gasoline and LPG," SAE 2009-01-0721, SAE International, 2009, 19 pages.

Attard, William P., et al.; "A Turbulent Jet Ignition Pre-Chamber Combustion System for Large Fuel Economy Improvements in a Modern Vehicle Powertrain," SAE 2010-01-1457, SAE Int. J. Engines, vol. 3, Issue 2, May 5, 2010, pp. 20-37.

Ma, Jia, et al.; "Adaptive Control of a Pneumatic Valve Actuator for an Internal Combustion Engine," IEEE Transactions on Control Systems Technology, Jul. 2011, pp. 730-743.

Attard, William P., et al.; "Flame Kernel Development for a Spark Initiated Pre-Chamber Combustion System Capable of High Load, High Efficiency and Near Zero NOx Emissions," SAE 2010-01-2260, SAE Int. J. Engines, vol. 3, Issue 2, Oct. 25, 2010, pp. 408-427.

Toulson, Elisa, et al.; "A Review of Pre-Chamber Initiated Jet Ignition Combustion Systems," SAE 2010-01-2263, SAE International, Oct. 25, 2010, 24 pages.

Mahle, "Turbulent Jet Ignition pre-chamber initiated combustion system supports high efficiency and near-zero engine-out NOx in naturally aspirated PFI engine," Green Car Congress, http://www.greencarcongress.com/2010/10/tji-20101027.html, published Oct. 27, 2010, 5 pgs.

Attard, Wiliiam P., et al.; "A New Combustion System Achieving High Drive Cycle Fuel Economy Improvements in a Modern Vehicle Powertrain," SAE 2011-01-0664, SAE International, Apr. 12, 2011, 23 pages.

Ma, Jia, et al.; "Adaptive Control of a Pneumatic Valve Actuator for an Internal Combustion Engine," IEEE Transactions of Control Systems Technology, vol. 19, No. 4, Jul. 2011, pp. 730-743.

Attard, William P., "A Single Fuel Pre-Chamber Jet Ignition Powertrain Achieving High Load, High Efficiency and Near Zero NOx Emissions," JSAE 20119100, SAE 2011-01-2023, SAE International, 2011, pp. 734-746.

Attard, William P., et al.; "Spark Ignition and Pre-Chamber Turbulent Jet Ignition Combustion Visualization," SAE 2012-01-0823, SAE International, Apr. 16, 2012, 16 pages.

Attard, William P., et al.; "A Lean Burn Gasoline Fueled Pre-Chamber Jet Ignition Combustion System Achieving High Efficiency and Low NOx at Part Load," SAE 2012-01-1146, SAE International, Apr. 16, 2012, 14 pages.

Toulson, Elisa, et al.; "Visualization of Propane and Natural Gas Spark Ignition and Turbulent Jet Ignition Combustion," SAE 2012-32-0002, SAE Int. J. Engines, vol. 5, Issue 4, Dec. 2012, 15 pages.

Schock, H., "Option #1: Air Injector and Fuel Injector Used," DOE presentation in Feb. 2015.

"Delphi Variable Cam Phaser," Powertrain Systems, Delphi, Published Jul. 26, 2017, pp. 1-3.

Wikipedia, "Exhaust Gas Recirculation," https://en.wikipedia.org/wiki/Exhaust_gas_recirculation, printed Jul. 26, 2017, four pages.

Toulson, E., et al., "Advanced Combustion Engines / 2015 Annual Report," Vehicle Technologies Office, Michigan State University, U.S. Department of Energy, 2015, pp. 162-166.

IAV Automotive Engineering Conference, Dec. 6-7, 2018, "Ignition Systems For Gasoline Engines".

German Patent Office Action (dated Mar. 16, 2022).

* cited by examiner

ENGINE TURBULENT JET IGNITION SYSTEM

CROSS-REFERENCE TO RELATED APPLICATION

This application claims the benefit of U.S. Provisional Application 62/950,511, filed Dec. 19, 2019, which is incorporated by reference herein.

BACKGROUND AND SUMMARY

The present application generally pertains to internal combustion engines and more particularly to an internal combustion engine including pre-chamber ignition.

It is known to experiment with internal combustion engines having a combustion pre-chamber, separate from a main combustion chamber or piston cylinder. See, for example, U.S. Pat. No. 10,161,296 entitled "Internal Combustion Engine" which issued to common inventor Schock et al. on Dec. 25, 2018; and PCT International Patent Publication No. WO 2019/027800 entitled "Diesel Engine with Turbulent Jet Ignition" which was commonly invented by Schock et al. Both of these are incorporated by reference herein. While these prior turbulent jet ignition configurations are significant improvements in the industry, additional improvements are desired to ease assembly and replacement, and to more concisely package the components, while achieving improved fuel efficiencies.

In accordance with the present invention, an engine ignition system employs a pre-assembled and/or removable cartridge. In another aspect, an ignitor, a fuel injector and a pre-chamber air inlet valve are all accessible from a top of a cartridge even after assembly of the cartridge to an engine cylinder head. A further aspect positions centerlines of an ignitor, a fuel injector and an air inlet valve angularly offset from each other and also angularly offset from a vertical centerline of a cartridge to which they are mounted.

In yet another aspect, an engine turbulent jet ignition system includes a preassembled cartridge having a generally triangular top view shape. A further aspect of an engine ignition system includes a cartridge, removably attachable to an engine, where the cartridge has multiple intersecting air passageways, entirely located in a body of the cartridge, which are straight and offset angled relative to each other. Moreover, a combustion pre-chamber includes a pre-chamber aperture having an offset angle allowing back-flowing of charge air from the main piston chamber during the compression stroke to create a swirling movement in the pre-chamber to assist with causing remaining fuel evaporation within the pre-chamber which beneficially deters soot production and other undesired combustion timing issues.

The present system is advantageous over conventional devices. For example, the present cartridge allows for pre-assembly of components at a different location than where the cartridge is assembled to the engine cylinder head. Furthermore, the present system makes component replacement easier since the components are accessible from a top of the cartridge. Fastening of the present cartridge is also faster and easier to access while the present cartridge is more commercially practical to fit within various engine cylinder head configurations. Additional advantageous and features of the present system and method will become apparent from the following description and appended claims, taken in conjunction with the accompanying drawings.

DETAILED DESCRIPTION

Figure 1:
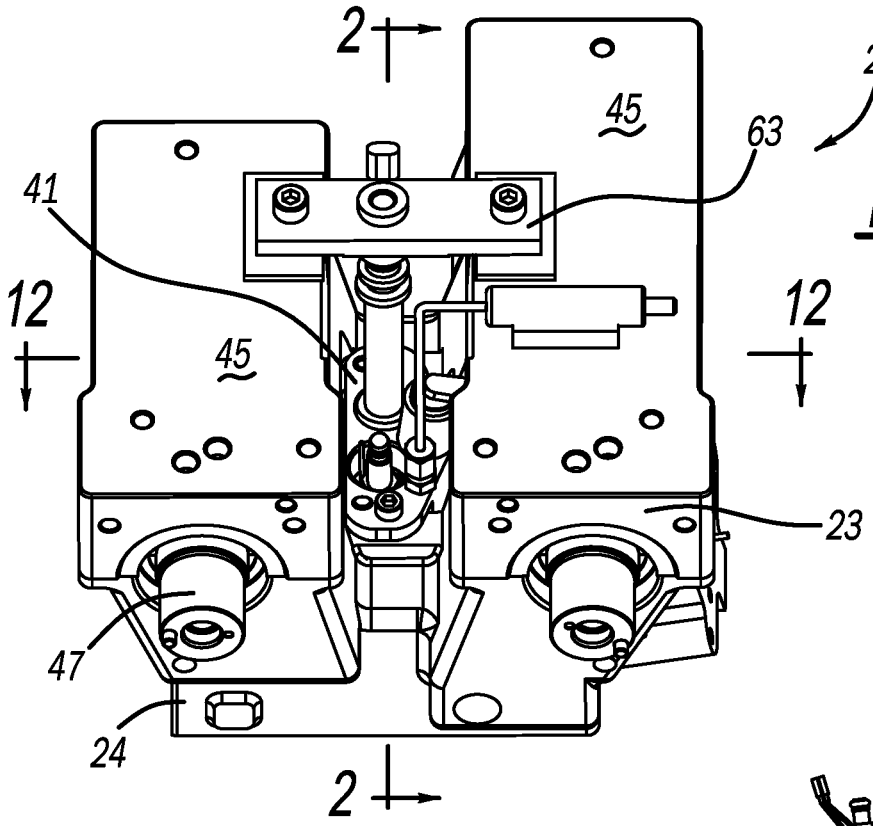
FIG. 1 is a top perspective view showing the present engine turbulent jet ignition system employing a cartridge fastened to an engine cylinder head.
Figure 2:
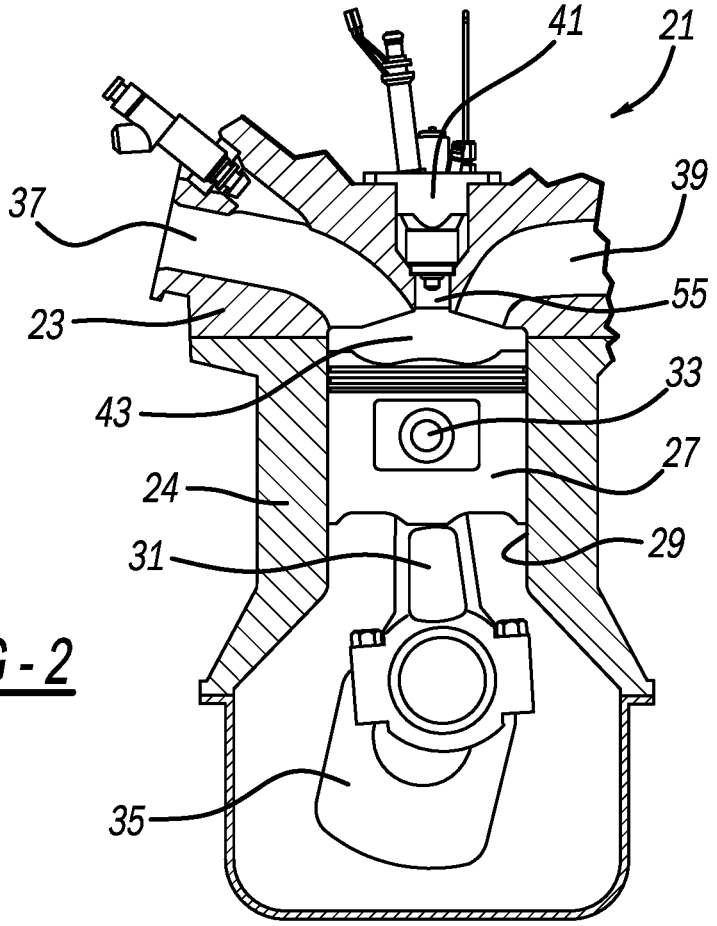
FIG. 2 is a cross-section view, taken along line 2-2 of FIG. 1, showing the present system.
Figure 3:
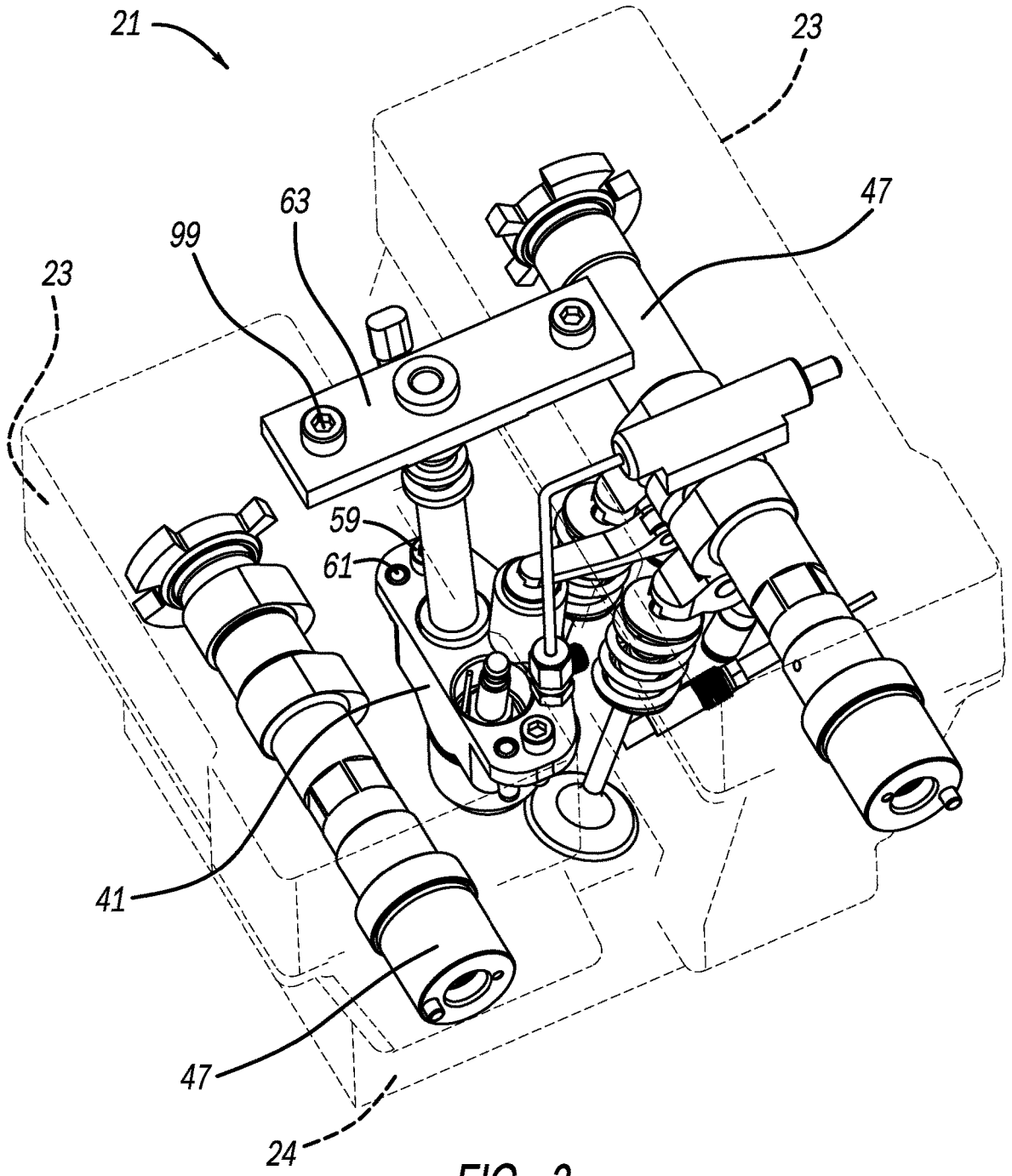
FIG. 3 is a top perspective view showing the cartridge and cam shafts of the present system with the engine cylinder head removed.

Referring to FIGS. 1-3, an internal combustion engine 21 of an automotive vehicle includes an engine block 24 and a cylinder head 23 mounted thereto. A main driving piston 27 operably advances and retracts within a cylinder cavity 29 in order to drive a connecting rod 31 spanning between a pin 33 of piston 27 and a crank shaft 35. Furthermore, cylinder head 23 includes an intake passage 37, an exhaust passage 39, and a cartridge 41 of a turbulent jet ignition system. A main combustion chamber 43 is located above main piston 27 partially within cylinder cavity 29 and cylinder head 23, directly below turbulent jet ignition cartridge 41. Cylinder head 23 optionally includes removable covers 45 and cam shafts 47 are rotatably located within the cylinder head. Although in some configurations, the cam shaft may be located with a cylinder block. Fuel injection into manifold or passage 37 is shown, however, direct fuel injection into main piston cylinder 43 may alternately be employed.

Figure 14:
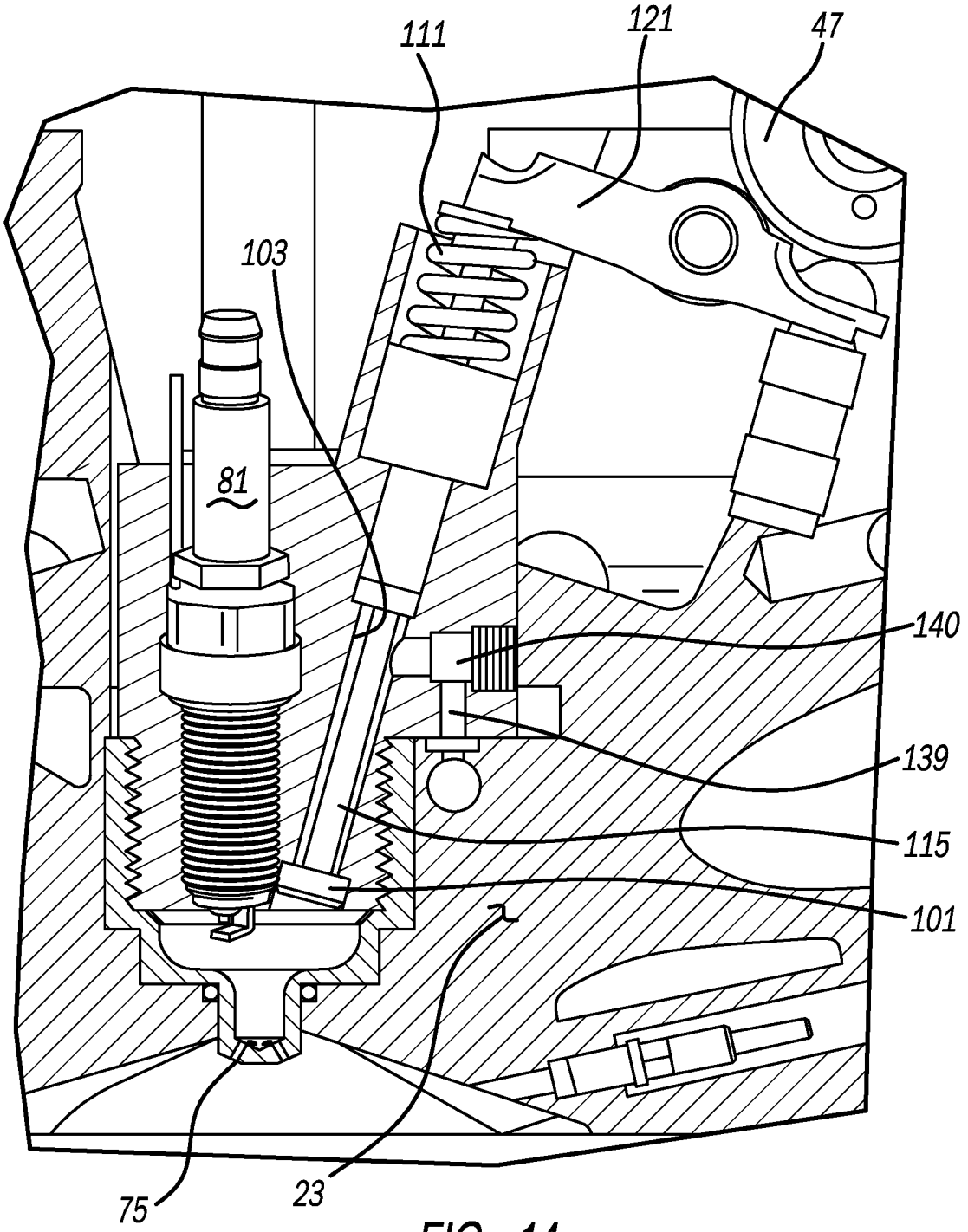
FIG. 14 is a cross-sectional and fragmentary view, taken opposite that of FIG. 8, showing the cartridge and engine cylinder head of the present system.

Referring now to FIGS. 3-14, turbulent jet ignition cartridge 41 includes a body 51 and a cup-shaped pre-chamber housing 53 which internally defines the pre-combustion cavity 55 therein. Cartridge 41 also has a laterally projecting flange 149 which is secured to top surfaces of cylinder head 25 via threaded fasteners 59, optional dowel pins 61, and a laterally elongated brace 63. At least one and more preferably three to ten elongated apertures 71 are always open and connect pre-chamber 55 to main combustion chamber 43. Each aperture is approximately 1 mm in diameter. In the example shown in FIGS. 8, 9 and 11, a length of a central aperture 71 is aligned with a longitudinal and vertical centerline 73 of pre-chamber housing 53 and body 51. FIG. 14 shows a version with only diagonally oriented apertures 75 which is configured to develop and impart a swirling flow in the pre-chamber during compression.

Turbulent jet ignition cartridge 41 includes an ignitor 81 such as a spark plug, glow plug or the like. Ignitor 81 has a middle section removably secured within an elongated opening 83 of body 51, and a distal end 85 located within pre-chamber 55 for providing a spark or other heat ignition source for a fuel-rich, fuel-air mixture within pre-chamber 55. An optional pre-chamber pressure transducer or indicator can be part of ignitor 81. It is also envisioned that an optional electrical resistance heater 90 may be internally located within pre-chamber 53.

A longitudinally elongated and generally cylindrical fuel injector 91 has a middle section removably disposed within another elongated opening 93 through body 51 such that a distal end 95 of the fuel injector is located within pre-chamber 55. Furthermore, the exemplary embodiment illustrates an uppermost proximal end 97 of fuel injector 91 coupled to crossing brace 63 which is, in turn, removably fastened to covers 45 of cylinder head 23 by way of threaded bolt fasteners 99. Alternately, the fuel injector can be located upstream of the pre-chamber air intake valve and/or both combined together.

A pre-chamber air inlet valve 101 has a middle section located within another elongated opening 103 through body 51, with an air valve seat 105 at a distal end thereof located within pre-chamber 55, and with a proximal end section 107 located within a generally cylindrical collar 109 integrally upstanding from body 51. Air inlet valve 101 includes a helically coiled spring 111 and a securing cap 113 retaining the spring to a longitudinally elongated shaft 115. Air inlet valve 101 is preferably a poppet valve type which is moved by a rocker arm 121 driven by cam shaft 47. Pre-chamber air inlet valve 101 is separate from a main piston chamber air intake valve. Alternately, the poppet valve may instead be a pintal or rotary valve.

Figure 4:
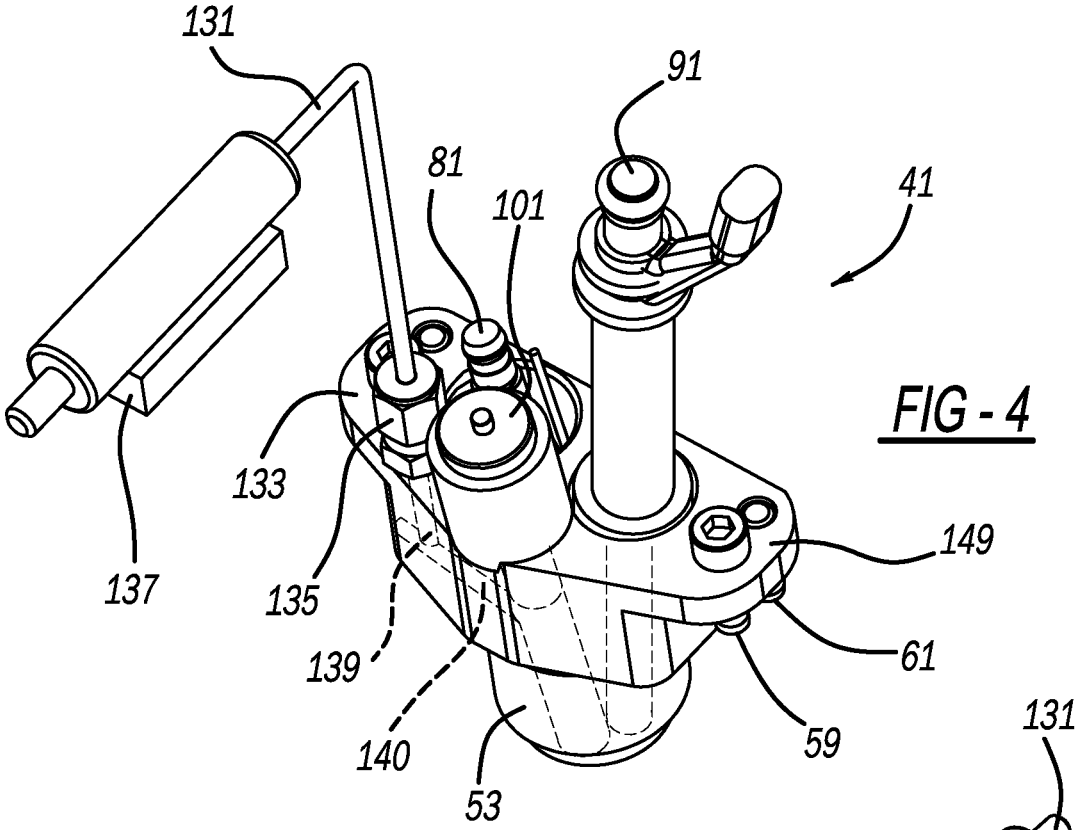
FIG. 4 is a top and side perspective view showing the cartridge of the present system.
Figure 5:
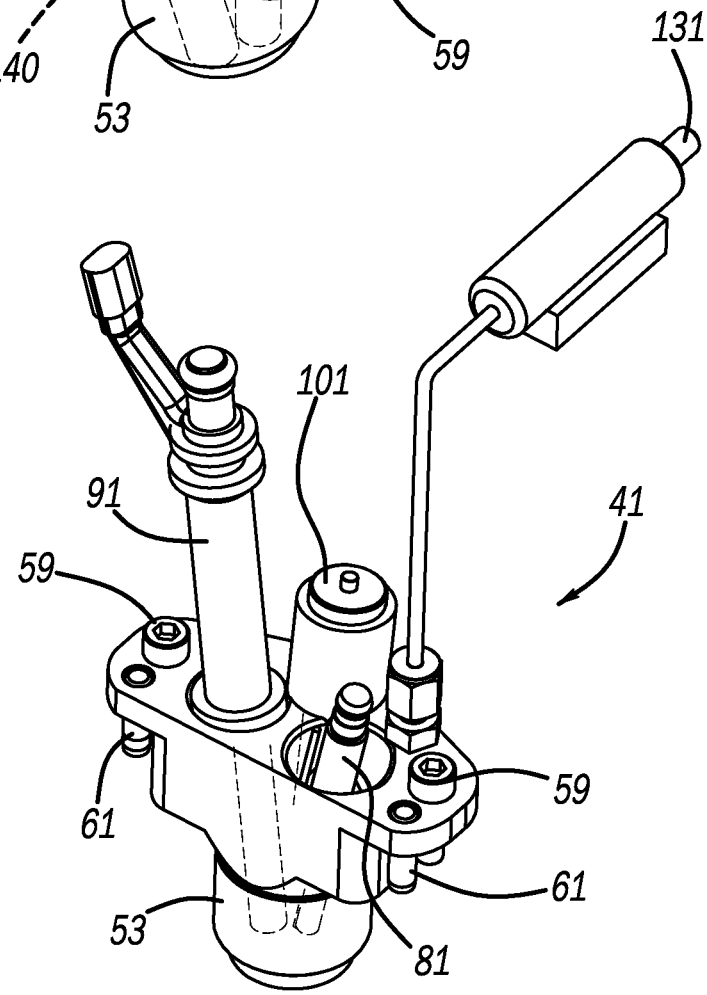
FIG. 5 is a top and side perspective view, taken opposite that of FIG. 4, showing the cartridge of the present system.

A fresh air conduit 131 is externally connected to a top surface 133 of cartridge 41 by way of a threaded fitting 135. An inline heater 137 is positioned adjacent air conduit 131. Heater 137 can be a primarily external heater (as shown in FIG. 4) or a primarily internal heater. In a version, it is envisioned that heater includes one or more electrically resistive wires or coils that are in contact with and heat aluminum metallic fins or structures projecting therefrom which contact conduit 131 and/or the fresh air flowing therethrough. For example, with the internal heater version, an open-cell metal foam, with highly interconnected porosity and circuitous paths, is inside the enlarged cylinder coaxially aligned with conduit 131, the foam structure being heated by the resistive coils. Such a heat transferring foam is disclosed in U.S. Patent Publication No. 2005/0092181 entitled "Active Filtration of Airborne Contaminants Employing Heated Porous Resistance-Heated Filters" to Shih et al., which is incorporated by reference herein. The present heater 137 and pre-chamber combination heats the incoming fresh air during initial engine start-up and initial warming; thereafter, the heater is deactivated. Alternately, a separate parallel bypass air conduit can feed directly to the body and air intake valve with an air flow valve switching between the two air conduits depending on whether heating is desired or not, as automatically controlled by a programmable pre-chamber or engine controller. Alternately, the heater may use resistance films within its body or air conduit rather than a wire or coil. The present heater and pre-chamber system is beneficially easier to install, easier to package, and more efficient and effective at heating fresh air prior to combustion than would be a heater associated only with the main piston cylinder.

Furthermore, a vertically elongated air passageway 139 intersects with a horizontally elongated air passageway 140 internal to body 51 of the cartridge. An upper end of passageway 139 is coupled to air conduit 131 and an innermost end of passageway 140 intersects opening 103 within which moves air inlet valve 101. Passageways 139 and 140 are preferably straight and a majority of these incoming air passageways are laterally overhanging and spaced further from a longitudinal centerline 73 of pre-chamber housing 53 as compared to an outside lateral surface 123 of pre-chamber housing 53 (as can best be observed in FIGS. 6 and 14). It is alternately envisioned that additional straight or curved air passageways can be provided within the cartridge body.

Air inlet valve 101 advantageously serves a duel synergistic purpose: to supply air into the pre-chamber for combustion therein, and also to provide an additional air flow into the pre-chamber before and/or after the combustion therein in order to purge out combustion residuals. Moreover, a primary direction of the main chamber air enters the pre-chamber during piston compression back through one or more apertures 71 which are three-dimensionally angled along a length thereof relative to centerline 73. This occurs when piston 27 upwardly strokes toward pre-chamber 53, such that some compressed combustion charge is forced back through apertures 71. The offset angle(s) of the apertures induce a swirling fluid flow effect within the pre-chamber which beneficially assists in evaporating any remaining fuel located in corners of the pre-chamber after combustion therein, thereby reducing soot production in the pre-chamber and other undesired characteristics.

Proximal upper ends of ignitor 81, fuel injector 91 and air inlet valve 101 are all accessible from an upper top surface 133 of cartridge 41. Furthermore, a longitudinal centerline 141 of ignitor 81 is offset angled by approximately 13° from longitudinal and vertical centerline 73 of pre-chamber housing 53. Furthermore, a longitudinal centerline 143 of air inlet valve 101 is offset angled by approximately 15° relative to longitudinal and vertical centerline 73 of pre-chamber housing 53. Similarly, a longitudinal centerline 145 of fuel injector 91 is offset angled by approximately 5° relative to longitudinal and vertical centerline 73 of the pre-chamber. Thus, centerlines 141, 143 and 145 are also offset angled from each other and define a triangularly oriented relationship between holes 147 which receive fasteners 59. Moreover, mounting flange 149, which includes holes 147 extending therethrough, of cartridge 41 has a generally triangular top view shape (as can be observed in FIGS. 7 and 10) with optionally arcuately curved peripheral corners 151 and/or curved intermediate peripheral surfaces 154 between the corners.

Figure 6:
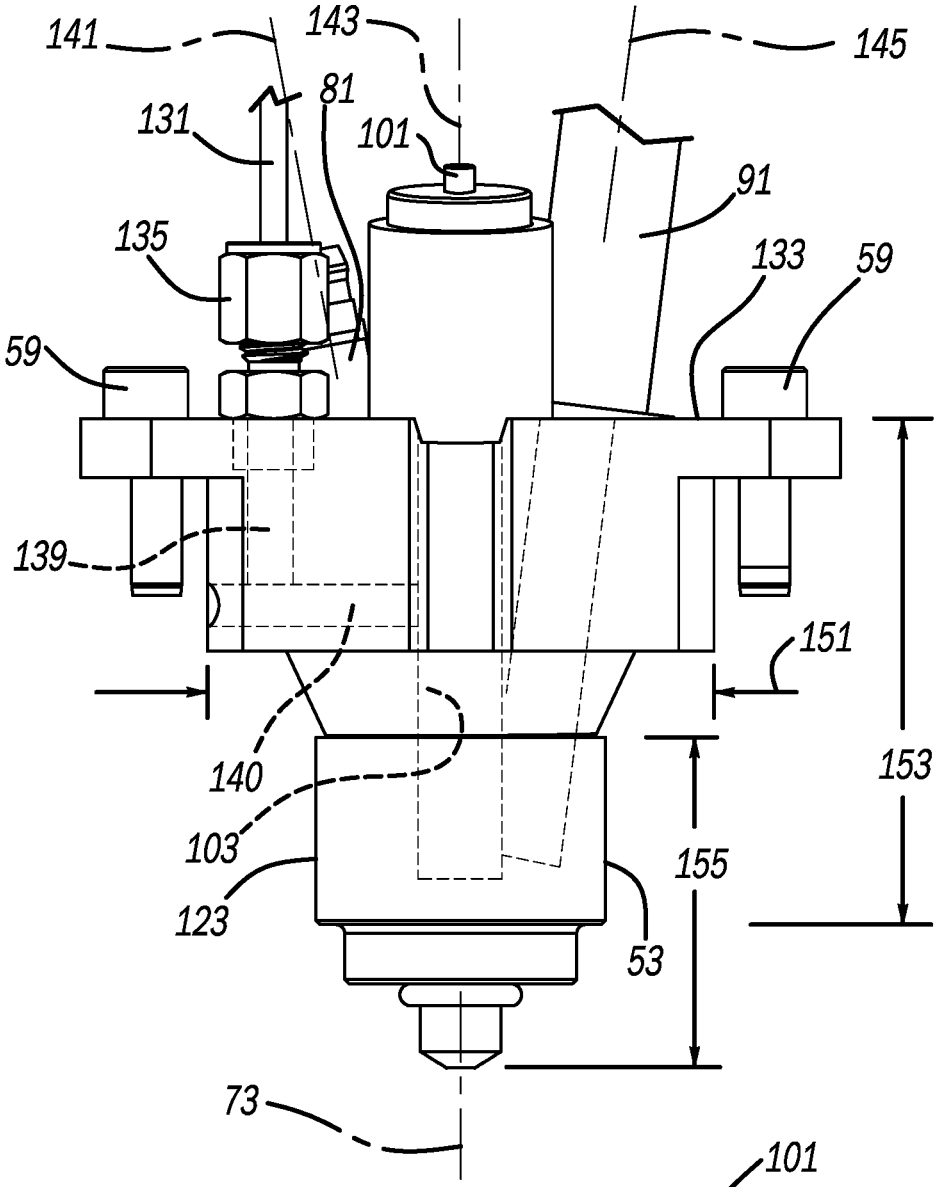
FIG. 6 is a side elevational view showing the cartridge of the present system.
Figure 7:
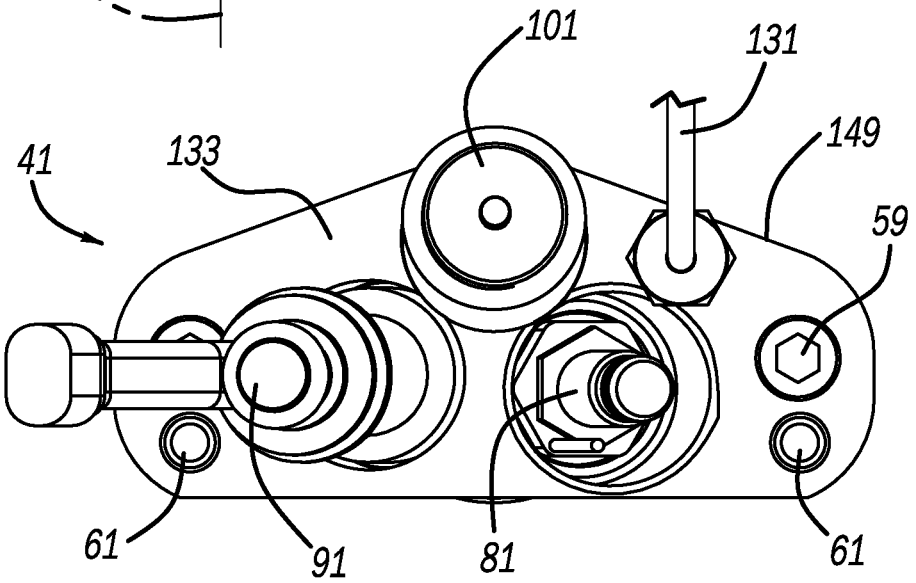
FIG. 7 is a top elevational view showing the cartridge of the present system.
Figure 8:
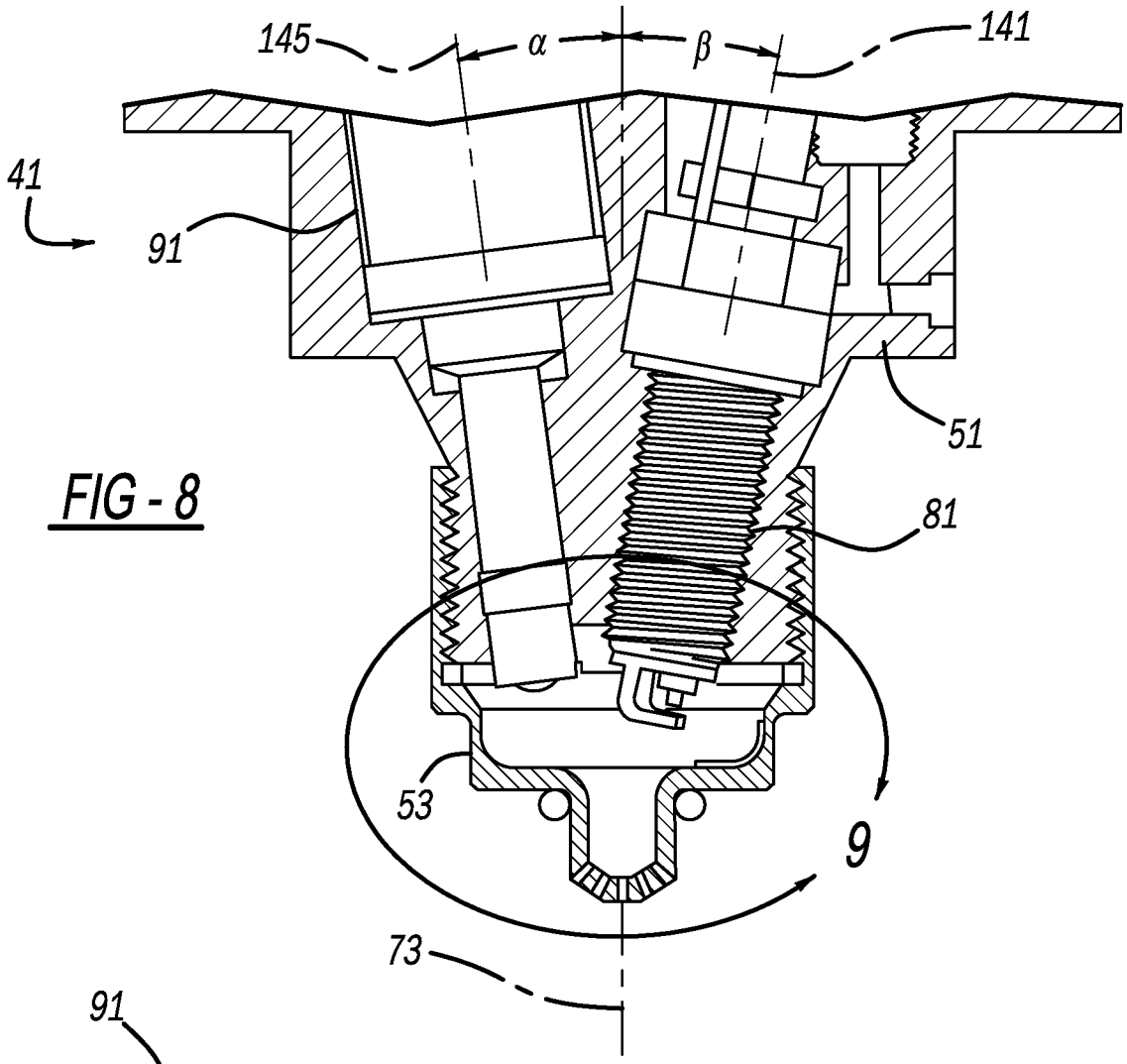
FIG. 8 is a cross-sectional and fragmentary view of the cartridge of the present system.
Figure 9:
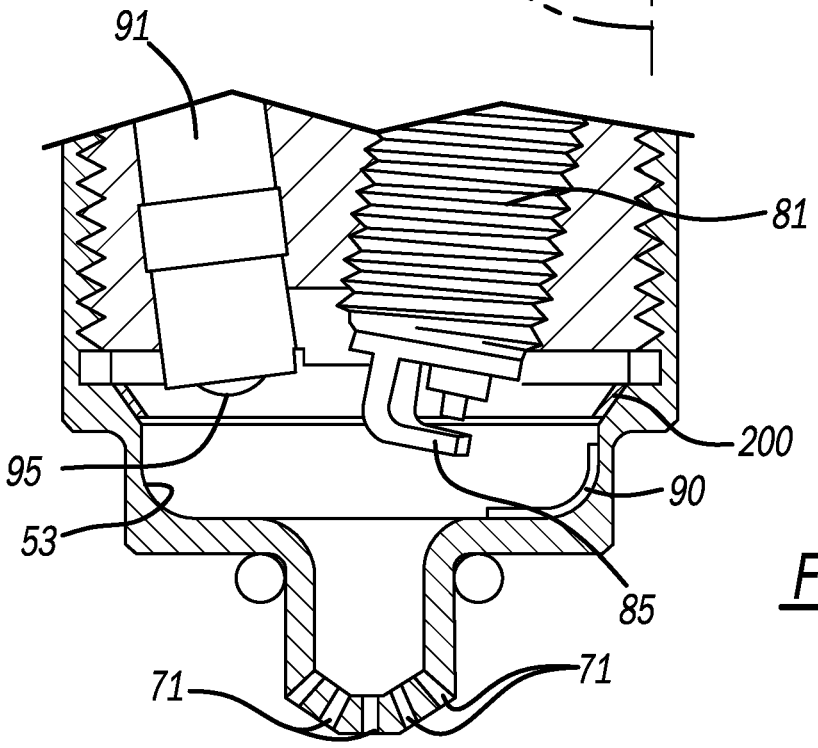
FIG. 9 is an enlarged cross-section view, taken within circle 9 of FIG. 8, showing the cartridge of the present system.
Figure 10:
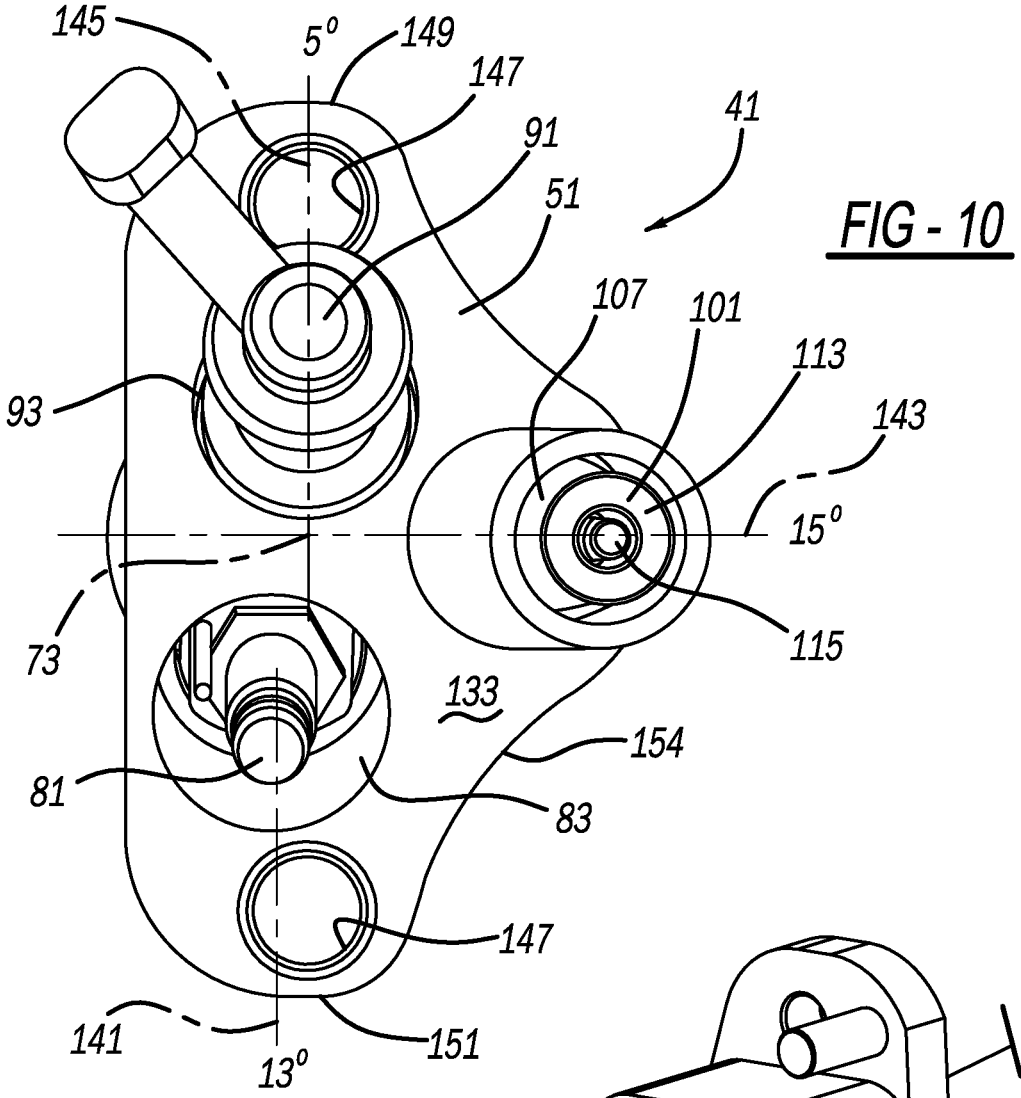
FIG. 10 is a top elevational view showing a variation of the cartridge of the present system with an air intake line and dowel holes omitted.
Figure 11:
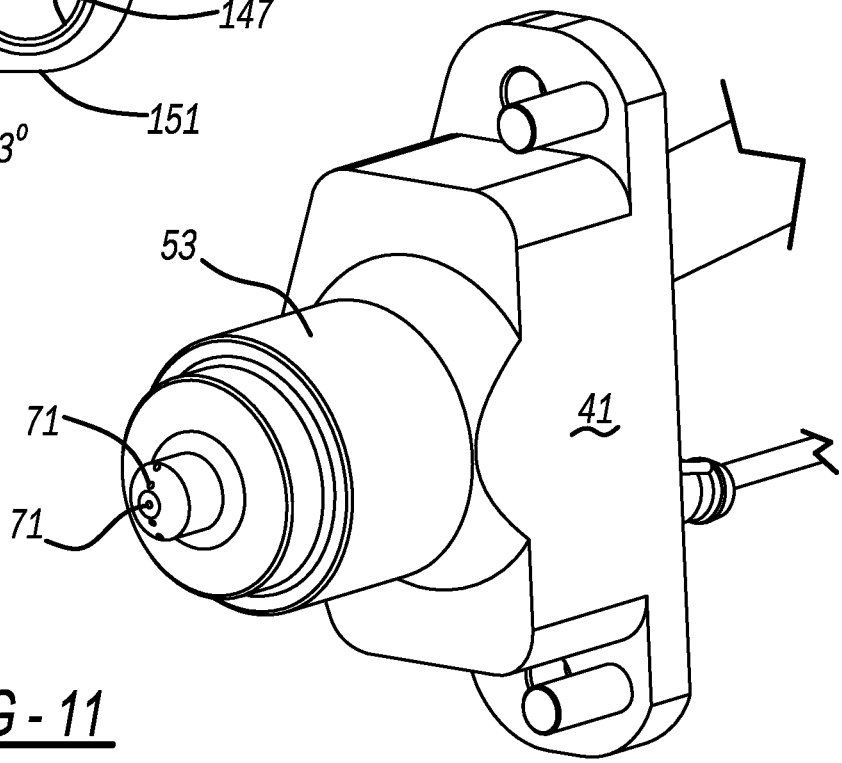
FIG. 11 is a bottom perspective view showing the cartridge of the present system.
Figure 12:
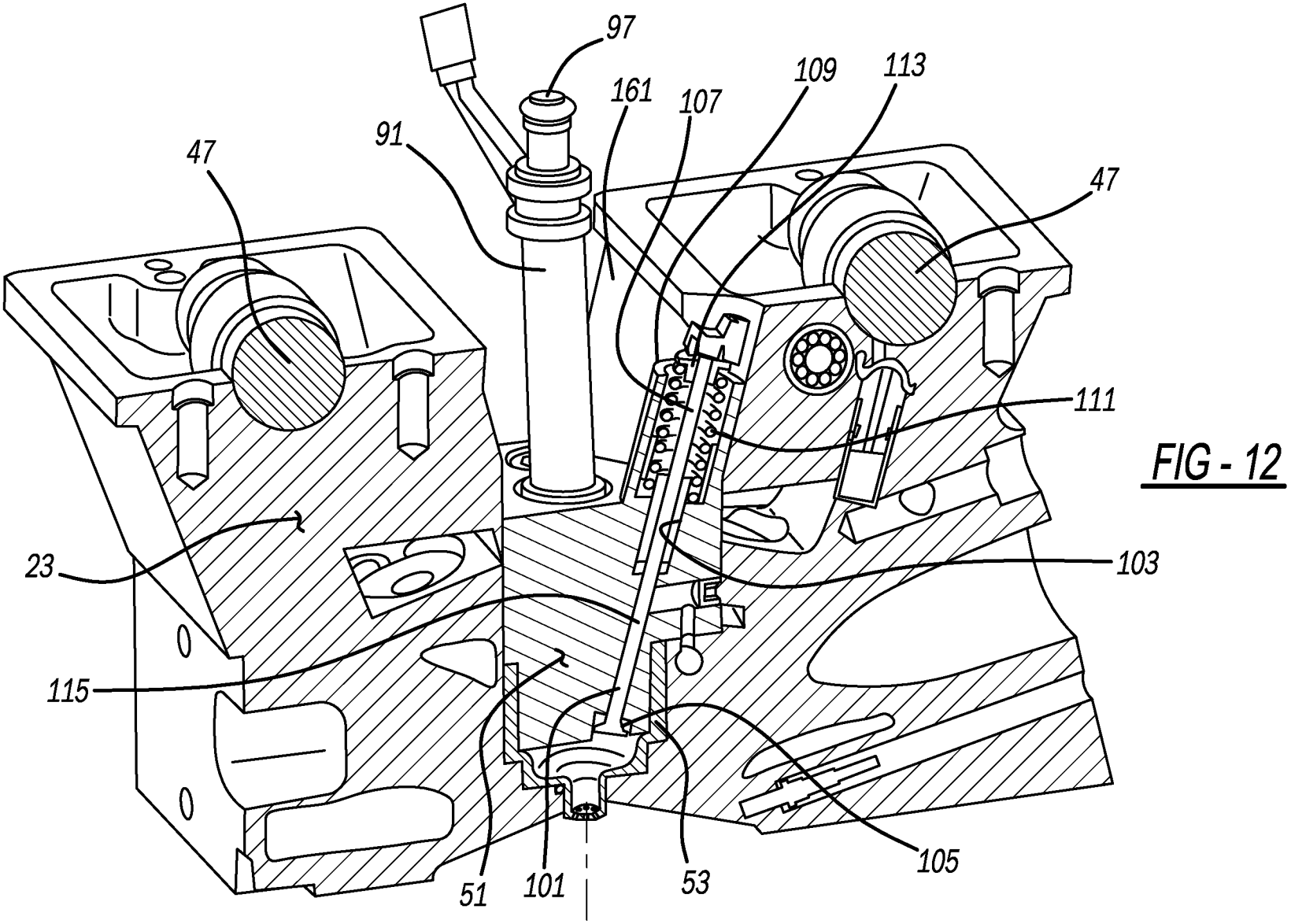
FIG. 12 is a cross-sectional perspective view, taken along line 12-12 of FIG. 1, showing the cartridge and engine cylinder head of the present system.
Figure 13:
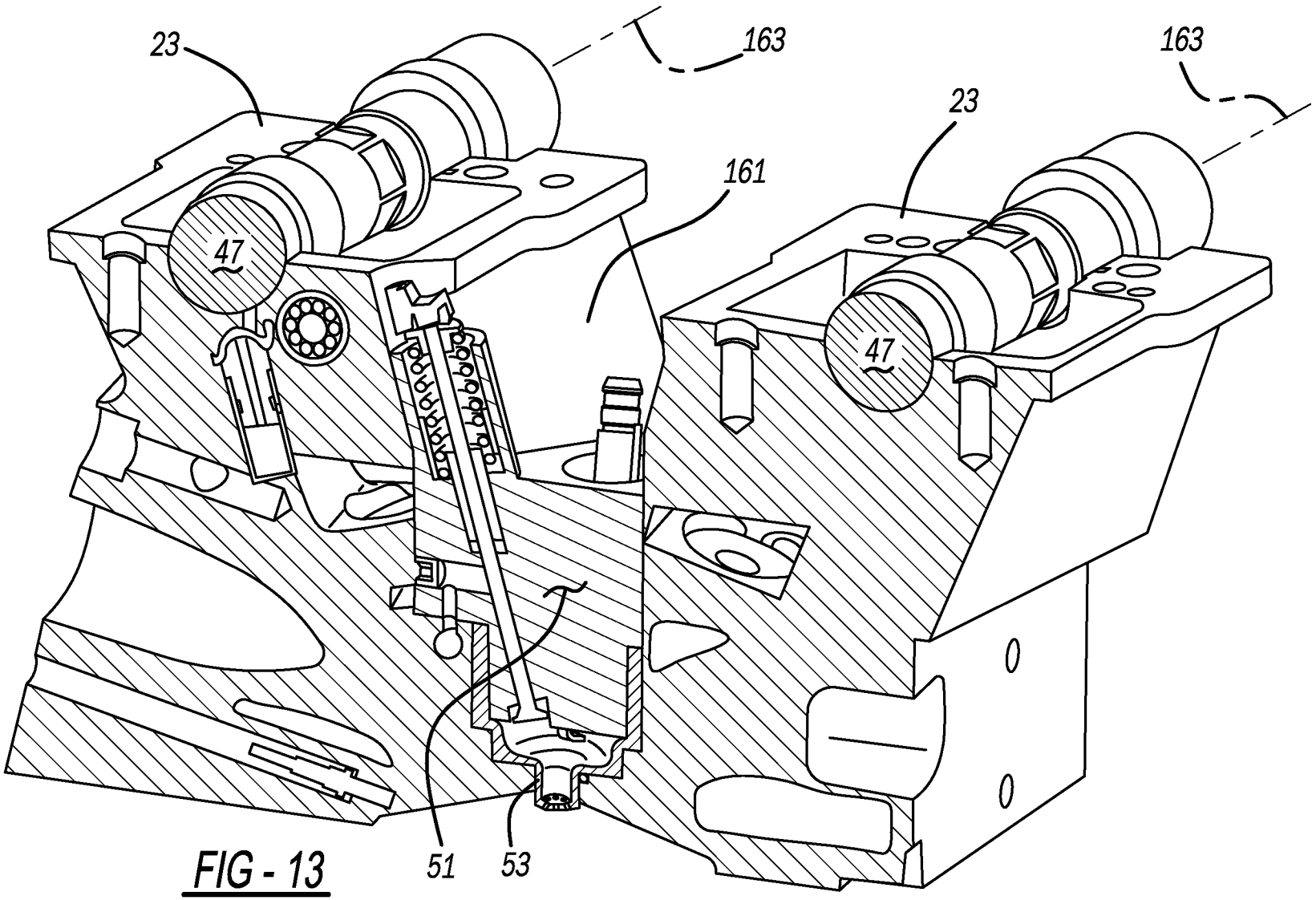
FIG. 13 is a cross-sectional perspective view, taken opposite that of FIG. 12, showing the cartridge and engine cylinder head of the present system.

It noteworthy that body 51 of cartridge 41 has a lateral dimension 151 (see FIG. 6) which is greater than an outside diameter of pre-chamber 53 and also greater than a width of body 51 in a direction perpendicular to that shown in FIG. 6. Also, a longitudinal length dimension 153 of body 51 is greater than a longitudinal length dimension 155 of pre-chamber 53. These dimensional and shaped relationships allow for more compact packaging yet provide user replacement accessibility from above, such that the preassembled cartridge 41 can be easily inserted and removed from within a valley 161 created between a pair of oppositely rising shoulders of cylinder head 23 if a V-shaped engine. Rotational axes 163 of cam shafts 47 are journaled within cylinder head 23 such that the longitudinal and vertical centerline 73 of pre-chamber housing 53 and body 51 is upwardly extending between and generally perpendicular to cam shaft axes 163. Alternately, the pre-chamber cartridge can be removably attached to an inline shaped engine.

Cartridge 41 is preferably manufactured independently of cylinder head 23. An exterior of the cartridge is machined from aluminum or steel, with the passageways internally machined therein. Thereafter, the body of the cartridge is furnace brazed or diffusion welded if the body is cast or machined as two separate parts. Alternately, the cartridge body and/or pre-chamber may be made from a ceramic or other low thermal conductivity material. A tapered and annular seal 200, preferably made from copper, internally contacts pre-chamber housing 53 and seals between it and the threaded mating of the bottom end of body 51, when they are screwed together. The ignitor, fuel injector and air valve are thereafter assembly to the body, such as by threaded screwing in of the components or as otherwise fastened.

Figure 15:
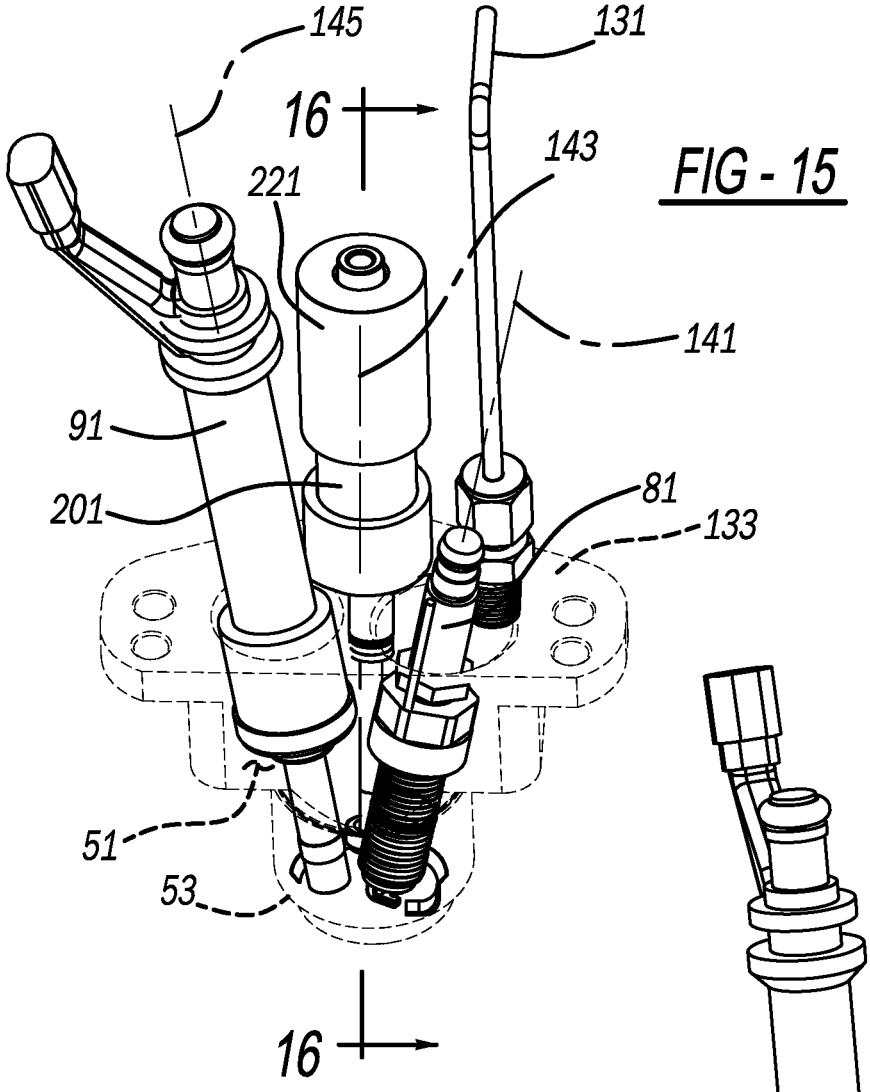
FIG. 15 is a top and side perspective view showing another variation of the cartridge of the present system.
Figure 16:
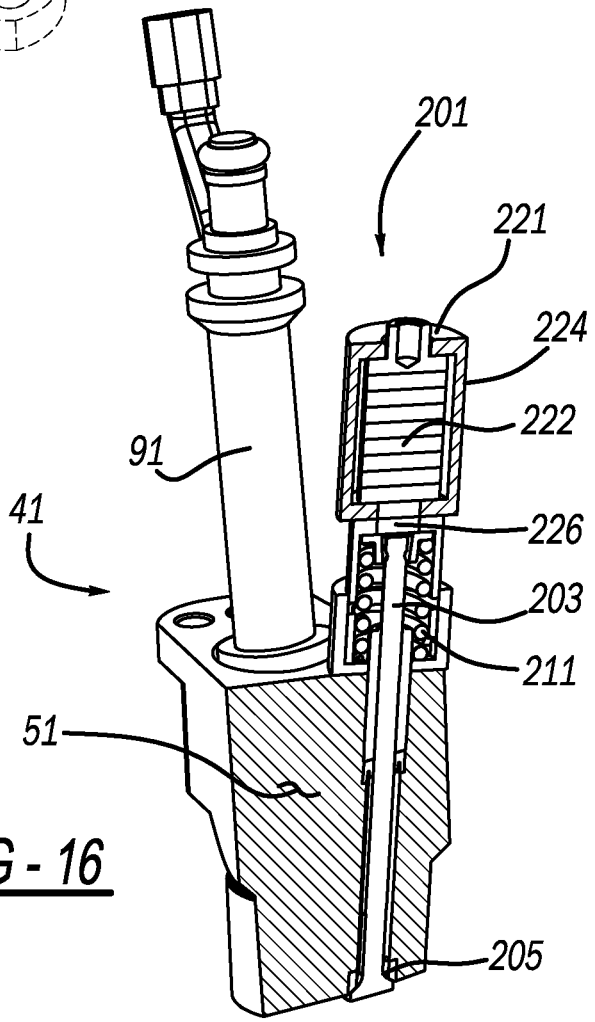
FIG. 16 is a cross-sectional perspective view, taken along line 16-16 of FIG. 15, showing the FIG. 15 variation of the cartridge of the present system.

FIGS. 15 and 16 illustrate an alternate version of air inlet valve 201 which is otherwise employed with the same turbulent jet ignition cartridge as previously disclosed. The present exemplary air inlet valve 201 includes an actuator 221 having a piezoelectric stack 222 within a case 224. A displacement slider 226 moves when the piezoelectric stack is electrically actuated which then longitudinally compresses helically coiled spring 211 for moving valve shaft 203 and valve seat 205 relative to cartridge body 51.

Figure 17:
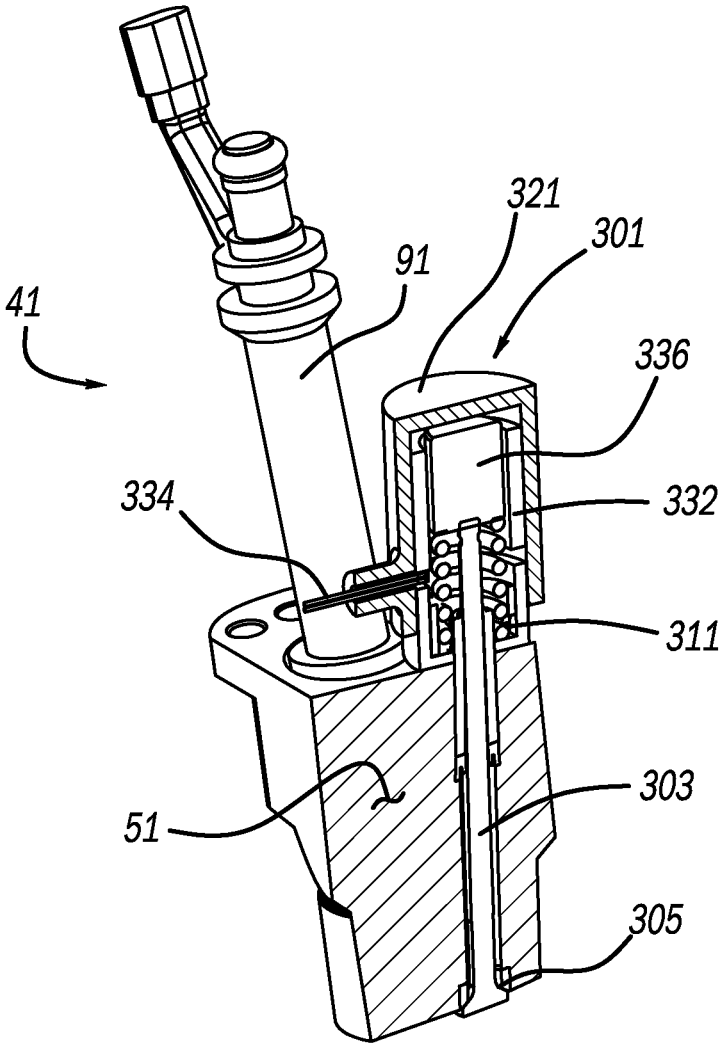
FIG. 17 is a cross-sectional perspective view like that of FIG. 16 but of yet another variation of the cartridge of the present system.

FIG. 17 shows yet another alternate variation of air inlet valve 301 otherwise employed with the same cartridge 41 as previously discussed hereinabove. This exemplary air inlet valve has an electrically conductive wire coil 332 within its actuator 321. When energized via electric wires 334, coil 332 will create an electromagnetic field which will linearly drive a central armature 336, containing a permanent magnet, to compress spring 311 and move valve shaft 303 and valve seat 305 relative to cartridge body 51. Alternately, a hydraulically or pneumatically controlled air valve actuator can be employed, each with corresponding electrical drivers, electrical circuits, air and/or oil fluid supplies, fluid valves and fluid lines.

While various feature of the present invention have been disclosed, it should be appreciated that other variations may be employed. For example, different air valve actuator configurations and positions can be employed, although various advantages of the present system may not be realized. As another example, the cartridge flange can have a vertical or diagonal section, but certain benefits may not be obtained. Additionally, alternate fuel-air passageways, conduits, openings and ports may be provided in the cartridge, although some advantages may not be achieved. Alternately, variations in the fuel-air mixture can be used, but performance may suffer. For example, various alternate liquid or gaseous fuels may be used in place of gasoline. Moreover, while the presently illustrated cartridge is best suited for an overhead cam engine, differently shaped and sized cartridges may be employed for differently configured engines such as for an inline-type of engine. In another variation, if the fuel injector and pre-chamber air inlet valve are combined, then only two openings (one for each) may be needed in the pre-chamber cartridge. Variations are not to be regarded as a a departure from the present disclosure, and all such modifications are intended to be included within the scope and spirit of the present invention.

The invention claimed is:

1. An engine ignition system comprising:

(a) an engine cylinder head including an upwardly facing surface and a receptacle configured to be accessible to a piston cylinder;

(b) a preassembled cartridge comprising:

(i) a body including openings therein;

(ii) a pre-chamber coupled to a bottom portion of the body, the pre-chamber including a pre-combustion cavity and at least one combustion exit aperture configured to be accessible to the piston cylinder;

(iii) an ignitor located in a first of the body openings, the ignitor having a longitudinal centerline and a distal end in or adjacent to the pre-combustion cavity;

(iv) a fuel injector located in a second of the body openings, the fuel injector having a longitudinal centerline and a distal end in or adjacent to the pre-combustion cavity;

(v) an air inlet valve located in a third of the body openings, the air inlet valve having a longitudinal centerline and a distal end in or adjacent to the pre-combustion cavity;

(vi) the centerlines of the ignitor, the fuel injector and the air inlet valve being angularly offset from each other and being angularly offset from a vertical centerline of the body and the pre-chamber;

(vii) the ignitor, the fuel injector and the air inlet valve being secured within their respective body openings and being accessible, from a top of the body;

(c) a fastener removably securing at least a portion of the cartridge within the receptacle of the engine cylinder head, and the fastener being removably fastened to the upwardly facing surface of the engine cylinder head.

2. The system of claim 1, wherein:

the air inlet valve is a purge valve including an actuator which is one of: (a) a hydraulic actuator, (b) a pneumatic actuator, (c) an actuator including an electric coil and a moving armature, and (d) a piezo-electric actuator;

an upper portion of the actuator extends above the cartridge when assembled thereto; and another portion of the actuator is located in a collar upwardly projecting from the top of the body.

3. The system of claim 1, further comprising:

a metallic, annular and tapered seal located adjacent to an interface between the pre-chamber and the body; and the pre-chamber being connected to the bottom of the body by mating threads in lateral walls thereof.

4. The system of claim 1, wherein:

the cartridge is located in a valley of the engine cylinder head between camshafts rotatable about parallel axes which are substantially perpendicular to the vertical centerline of the body and the pre-chamber; and multiples of the fastener fasten a laterally projecting flange of the cartridge to the engine cylinder head laterally inboard of the camshaft axes.

5. The system of claim 1, wherein:

the cartridge has curved corners;

the air inlet valve being adjacent to one of the corners; and the ignitor, the fuel injector and the air inlet valve are arranged in a triangular top view orientation relative to each other.

6. The system of claim 1 , wherein:

the body of the cartridge has a largest vertical dimension greater than a largest vertical dimension of the pre-chamber; and a largest horizontal dimension of the body is greater than a largest horizontal dimension of the pre-chamber.

7. An engine ignition system comprising:

(a) a preassembled cartridge comprising:

(i) a body including openings therein;

(ii) a pre-chamber coupled to a bottom portion of the body, the pre-chamber including at least one combustion exit aperture configured to be accessible to a piston cylinder;

(iii) an ignitor located in a first of the body openings, the ignitor having a longitudinal centerline and a distal end in the pre-chamber;

(iv) a fuel injector located in a second of the body openings, the fuel injector having a longitudinal centerline and a distal end in the pre-chamber;

(v) an air inlet valve located in a third of the body openings, the air inlet valve having a longitudinal centerline and a distal end in the pre-chamber;

(vi) the centerlines of the ignitor, the fuel injector and the air inlet valve being angularly offset from each other and being angularly offset from a vertical centerline of the body and the pre-chamber;

(vii) the ignitor, the fuel injector and the air inlet valve being secured within their respective body openings and being accessible from a top of the body;

(b) a fastener configured to removably secure at least a portion of the cartridge to an upwardly facing surface of an engine cylinder head;

(c) an incoming air conduit connected to the cartridge body, the cartridge body including multiple straight air passageways connected to the third opening of the body to be controlled by the air inlet valve, at least two of the straight air passageways being offset angled from each other at their intersection located internal to the body between the air conduit and the third opening of the body; and (d) a heater coupled to the air conduit.

8. An engine ignition system comprising a cartridge comprising:

(a) a body including openings therein;

(b) a pre-chamber coupled to a bottom portion of the body, the pre-chamber including a pre-combustion cavity and at least one combustion exit aperture;

(c) an ignitor located in a first of the body openings, the ignitor having a longitudinal centerline and a distal end in or adjacent to the pre-combustion cavity;

(d) a fuel injector located in a second of the body openings, the fuel injector having a longitudinal centerline and a distal end in or adjacent to the pre-combustion cavity;

(e) an air inlet valve located in a third of the body openings, the air inlet valve having a longitudinal centerline and a distal end in or adjacent to the pre-combustion cavity;

(f) the ignitor, the fuel injector and the air inlet valve being secured within their respective openings and being accessible, from a top of the body;

(g) a flange located adjacent an upper portion of the body above the pre-chamber, and including at least one fastener hole through the flange; and (h) the cartridge having a periphery with a substantially triangular top view shape and at least one curved peripheral section thereof.

9. The system of claim 8, wherein the at least one fastener hole includes two fastener holes through the flange which laterally projects from the body, a first of the fastener holes being adjacent a first corner and a second of the fastener holes being adjacent to a second corner of the triangular top view shape.

10. The system of claim 9, wherein the air inlet valve is adjacent to a third corner of the triangular top view shape, and the ignitor and the fuel injector are located between the holes in a top view.

11. The system of claim 8, wherein the at least one curved peripheral section includes curved corners of the flange.

12. The system of claim 8, wherein:

centerlines of the ignitor, the fuel injector and the air inlet valve are angularly offset from each other and are angularly offset form a vertical centerline of the body and the pre-chamber; and the ignitor, the fuel injector and the air inlet valve are arranged in a triangular top view orientation relative to each other.

13. The system of claim 8, further comprising:

an engine cylinder head;

camshafts;

the cartridge being located in a valley of the engine cylinder head between the camshafts which are rotatable about parallel axes, the axes being substantially perpendicular to a vertical centerline of the pre-chamber;

fasteners removably fasten the cartridge of the engine cylinder head; and the ignitor, the fuel injector, the air inlet valve and the pre-chamber being preassembled to the body prior to the cartridge being assembled to the engine cylinder head.

14. The system of claim 8, wherein:

the body of the cartridge has a largest vertical dimension greater than a largest vertical dimension of the pre-chamber; and a largest horizontal dimension of the body is greater than a largest horizontal dimension of the pre-chamber.

15. An engine ignition system comprising a cartridge comprising:

(a) a body including openings therein;

(b) a pre-chamber coupled to the body, the pre-chamber including a cavity and at least one combustion exit aperture;

(c) an ignitor located in a first of the body openings;

(d) a fuel injector located in a second of the body openings;

(e) an air inlet valve located in a third of the body openings;

(f) a mounting flange projecting from the body;

(g) the body of the cartridge having a largest longitudinal dimension greater than a largest longitudinal dimension of the pre-chamber;

(h) a largest lateral dimension of the body being greater than a largest lateral dimension of the pre-chamber; and (i) a portion of the body adjacent to the flange being laterally enlarged further away from a longitudinal centerline of the pre-chamber as compared to an opposite side of the body.

16. The system of claim 15, wherein centerlines of the ignitor, the fuel injector and the air inlet valve are angularly offset from each other and are angularly offset from the longitudinal centerline of the pre-chamber.

17. The system of claim 15, further comprising a hollow collar extending above and being an integral single piece with the flange and the body of the cartridge, and an upper portion of the air inlet valve being located in the collar.

18. The system of claim 15, further comprising:

an incoming air conduit externally connected to a same end of the cartridge body as the ignitor, the fuel injector and the air inlet valve; and a heater coupled to the air conduit, the heater being external to the body of the cartridge.

19. The system of claim 15, further comprising:

an engine cylinder head;

camshafts;

the cartridge being located in a valley of the engine cylinder head between the camshafts which are rotatable about parallel axes, the axes being substantially perpendicular to the longitudinal centerline of the pre-chamber;

the flange laterally projects more than a lateral periphery of the pre-chamber, the flange being located adjacent an upper portion of the body above the pre-chamber; and fasteners removably fasten the flange of the cartridge to the engine cylinder head.

20. An engine ignition system comprising a cartridge comprising:

(a) a pre-chamber including a pre-combustion cavity, combustion exit apertures and a longitudinal centerline;

(b) an ignitor located in the cartridge with a distal end accessible to the pre-combustion cavity, the ignitor being one of: a spark plug or glow plug;

(c) a fuel injector located in the cartridge with a distal end accessible to the pre-combustion cavity;

(d) an air inlet valve located in the cartridge with a distal end accessible to the pre-combustion cavity; and (e) an air flow path of at least one of the exit apertures of the pre-chamber being offset angled from the longitudinal centerline of the pre-chamber such that air flowing back from a piston cylinder causes swirling of the air within the pre-chamber to assist in evaporation of any of the fuel remaining therein a fuel combustion in the pre-chamber, the air flowing back being configured to occur when a piston upwardly strokes toward the pre-chamber such that some compressed combustion charge is forced back through the exit apertures.

21. The system of claim 20, wherein the ignitor, the fuel injector and the air inlet valve are accessible from a top of the cartridge when the cartridge is removably assembled to an engine cylinder head.

22. The system of claim 20, wherein:

centerlines of the ignitor, the fuel injector and the air inlet valve are angularly offset from each other; and there are at least three of the apertures which are all located on a vertical plane and which are three-dimensionally angularly offset from each other.

23. The system of claim 20, wherein an internal surface of the pre-chamber comprises a longitudinally curved and inwardly stepped shoulder located between a lateral plane, defined by the distal end of the ignitor, and a longitudinally extending and central extension of the pre-combustion cavity, with the evaporation occurring at the shoulder, and a longitudinal length of the central extension being less than an outer diameter of the shoulder.

24. An engine ignition system comprising a cartridge comprising:

(a) a pre-chamber including a pre-combustion cavity, combustion exit apertures and a longitudinal centerline;

(b) an ignitor located in the cartridge with a distal end accessible to the pre-combustion cavity;

(c) a fuel injector located in the cartridge with a distal end accessible to the pre-combustion cavity;

(d) an air inlet valve located in the cartridge with a distal end accessible to the pre-combustion cavity; and (e) an air flow path of at least one of the exit apertures of the pre-chamber being offset angled from the longitudinal centerline of the pre-chamber;

(f) the air inlet valve is a purge valve including an actuator which is one of: (i) a hydraulic actuator, (ii) a pneumatic actuator, (iii) an actuator including an electric coil and a moving armature, or (iv) a piezo-electric actuator;

(g) an upper portion of the actuator extending above the cartridge when assembled thereto;

(h) an incoming air conduit externally connected to a same end of the cartridge body as the ignitor, the fuel injector and the air inlet valve;

(i) heater coupled to the air conduit, the heater being external to the body of the cartridge; and (j) the ignitor, the fuel injector, the air inlet valve and the air conduit are preassembled to the cartridge prior to the cartridge being removably fastened to an engine cylinder head.

25. The system of claim 24, wherein longitudinal centerlines of the ignitor, the fuel injector and the air inlet valve are angularly offset from each other and are angularly offset from the longitudinal centerline of the pre-chamber.

* * * * *